US007723973B2

(12) United States Patent
Wong et al.

(10) Patent No.: US 7,723,973 B2
(45) Date of Patent: May 25, 2010

(54) THREE-PHASE ALTERNATING CURRENT VOLTAGE REGULATOR

(75) Inventors: Shih-Fang Wong, Taipei Hsien (TW); Tsung-Jen Chuang, Taipei Hsien (TW); Jun Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 389 days.

(21) Appl. No.: 11/748,502

(22) Filed: May 15, 2007

(65) Prior Publication Data

US 2008/0150510 A1 Jun. 26, 2008

(30) Foreign Application Priority Data

Dec. 20, 2006 (CN) ..... 2006 1 0157697

(51) Int. Cl.
*G05F 5/00* (2006.01)

(52) U.S. Cl. ..... 323/301

(58) Field of Classification Search ..... 323/299, 323/300, 301

See application file for complete search history.

(56) References Cited

U.S. PATENT DOCUMENTS 4,258,312 A * 3/1981 Gilcher ..... 323/306
4,288,737 A * 9/1981 McClain et al. ..... 323/254
4,346,339 A * 8/1982 Lewandowski ..... 323/245
5,019,952 A * 5/1991 Smolenski et al. ..... 363/16
5,252,926 A * 10/1993 Menegoli ..... 324/545
5,708,577 A * 1/1998 Mckinley ..... 363/89
6,665,198 B2 * 12/2003 Tasi et al. ..... 363/39
7,145,266 B2 * 12/2006 Lynch et al. ..... 307/65
7,235,891 B2 * 6/2007 Tokiwa et al. ..... 290/10
7,466,569 B2 * 12/2008 Yang et al. ..... 363/21.03
2008/0150510 A1 * 6/2008 Wong et al. ..... 323/301

FOREIGN PATENT DOCUMENTS

CN 2230941 Y 7/1996

* cited by examiner

*Primary Examiner*—Adolf Berhane
*Assistant Examiner*—Yemane Mehari
(74) *Attorney, Agent, or Firm*—Frank R. Niranjan

(57) ABSTRACT

A three-phase AC voltage regulator is for adjusting a line voltage on transmission lines. The three-phase AC voltage regulator includes a sampling circuit, a reference-voltage circuit, a comparator, a switch, a power supply, and a compensator. The sampling circuit is for sampling the line voltage. The reference-voltage circuit is for receiving a line-to-line voltage from the transmission lines and generating a standard voltage. The comparator is for comparing the line voltage and the standard voltage to obtain a signal. The switch is for being turned on or off based on the signal. The power supply is for supplying various electric powers to the compensator. The compensator is for receiving the electric power and generating compensating voltages. The compensating voltages are used to compensate the line voltage.

20 Claims, 5 Drawing Sheets

THREE-PHASE ALTERNATING CURRENT VOLTAGE REGULATOR

BACKGROUND OF THE INVENTION

1. Field of the Invention

The present invention generally relates to three-phase alternating current voltage regulators for balancing voltages on transmission lines between three-phase generators and loads, and more particularly to an automatically controlled three-phase alternating current voltage regulator.

2. Description of Related Art

Alternating current (AC) voltages generated from a three-phase generator are transmitted on transmission lines to various loads, such as electric motors. However, climatic conditions may result in fluctuation of the voltages in the transmission lines. If the loads receive the unstable voltages, they will operate unsteadily. Thus, it is necessary to balance the AC voltages in the transmission lines.

A microcomputer is typically used in a generator. Referring to FIG. 5, transmission lines 10 transmitting the alternating voltage generated from a three-phase generator 80 to a load 90 is depicted. A three-phase AC voltage regulator 999 is used for balancing the voltages in the transmission lines 10. The three-phase AC voltage regulator 999 includes a sampling circuit 20, a reference-voltage circuit 30, a microcomputer 40, an interface 50, and a compensator 70.

A line voltage is sampled from the transmission lines 10 by the sampling circuit 20. A line-to-line voltage is received from the transmission lines 10, and converted to a standard voltage by the reference-voltage circuit 30. The line voltage and the standard voltage are received, and compared by the microcomputer 40 to obtain a signal. The line voltage in the transmission lines 10 is compensated with the signal by the compensator 70. The microcomputer 40 is connected with a desktop computer via the interface 50 to monitor the three-phase AC voltage regulator 999.

However, the microcomputer is expensive, making the regulator also expensive.

Therefore, a three-phase AC voltage regulator is needed in the industry to address the aforementioned deficiency.

SUMMARY OF THE INVENTION

A three-phase AC voltage regulator is for adjusting a line voltage on transmission lines. The three-phase AC voltage regulator includes a sampling circuit, a reference-voltage circuit, a comparator, a switch, a power supply, and a compensator. The sampling circuit is for sampling the line voltage. The reference-voltage circuit is for receiving a line-to-line voltage from the transmission lines. The comparator is for comparing the line voltage and the standard voltage to obtain a signal. The switch is for being turned on or turned off based on the signal. The power supply is for supplying various electric powers to the compensator. The compensator is for receiving the electric power and generating compensating voltages. The compensating voltages are used to compensate the line voltage.

Other systems, methods, features, and advantages of the present three-phase AC voltage regulator will be or become apparent to one with skill in the art upon examination of the following drawings and detailed description. It is intended that all such additional systems, methods, features, and advantages be included within this description, be within the scope of the present device, and be protected by the accompanying claims.

BRIEF DESCRIPTION OF THE DRAWINGS

Many aspects of the present three-phase AC voltage regulator can be better understood with reference to the following drawings. The components in the drawings are not necessarily to scale, emphasis instead being placed upon clearly illustrating the principles of the present device. Moreover, in the drawings, like reference numerals designate corresponding parts throughout the several views.

DETAILED DESCRIPTION OF THE INVENTION

Reference will now be made to the drawings to describe a preferred embodiment of the present three-phase AC voltage regulator.

Figure 1:
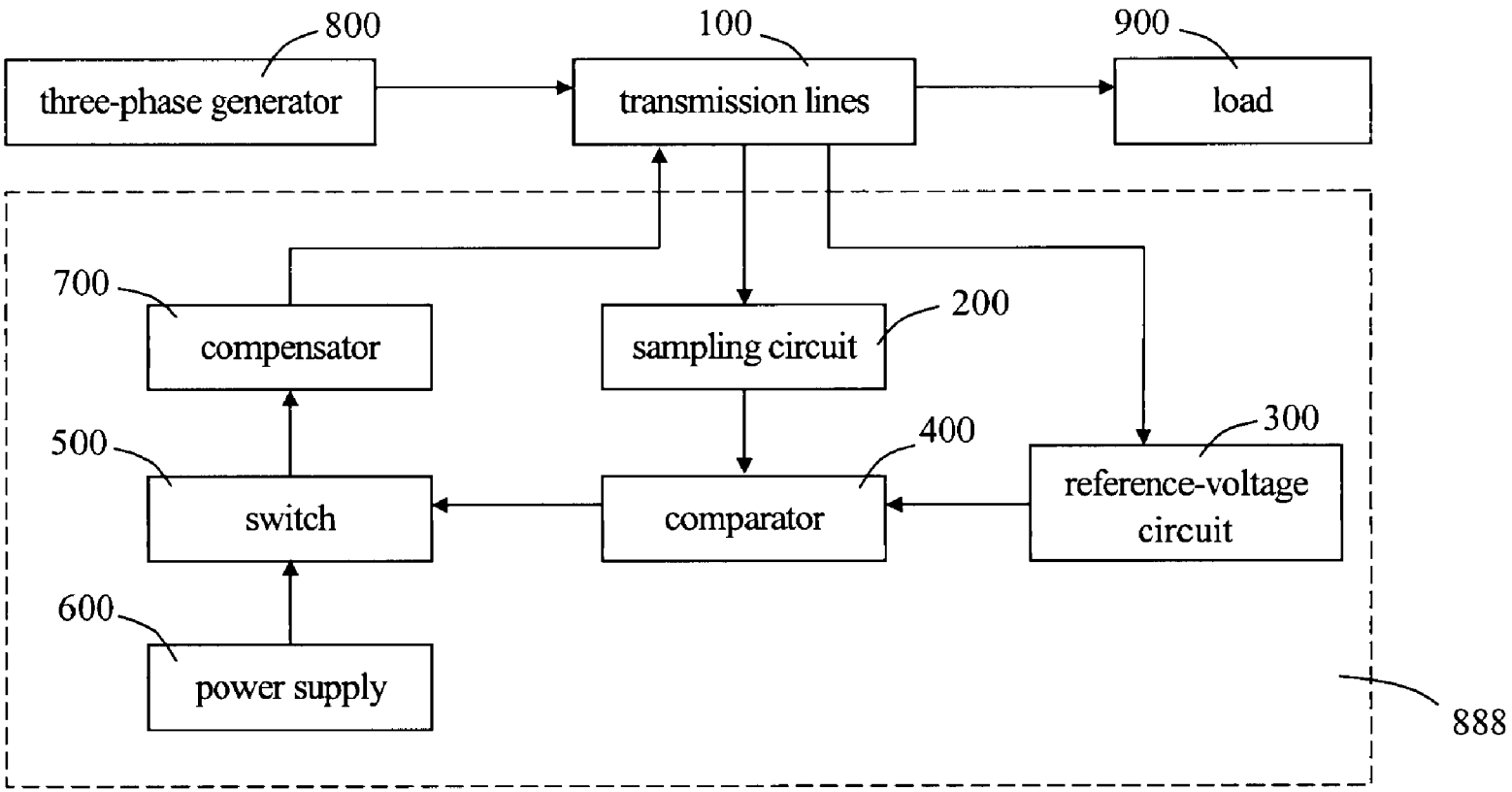
FIG. 1 is a block diagram showing a three-phase AC voltage regulator in accordance with an exemplary embodiment, the three-phase regulator including a sampling circuit, a reference-voltage circuit, a comparator, a switch, and a compensator.

Referring to FIG. 1, a three-phase AC voltage regulator 888 in accordance with a preferred exemplary embodiment is used for balancing voltage on transmission lines 100 that connects a three-phase generator 800 and a load 900. The three-phase AC voltage regulator 888 includes a sampling circuit 200, a reference-voltage circuit 300, a comparator 400, a switch 500, a power supply 600, and a compensator 700.

The sampling circuit 200 is used for sampling a line voltage from the transmission lines 100. The reference-voltage circuit 300 is for receiving a line-to-line voltage from the transmission lines 100, and converting the line-to-line voltage to a standard voltage. The comparator 400 is used for comparing the line voltage and the standard voltage to obtain a signal. The power supply 600 is used for supplying an electric power to the compensator 700. The compensator 700 is used for receiving the electric power, and generating compensating voltage to be used to compensate the line voltage in the transmission lines 1 00. The switch 500 is used for switching the electric power to the compensator 700 according to the signal.

Figure 2:
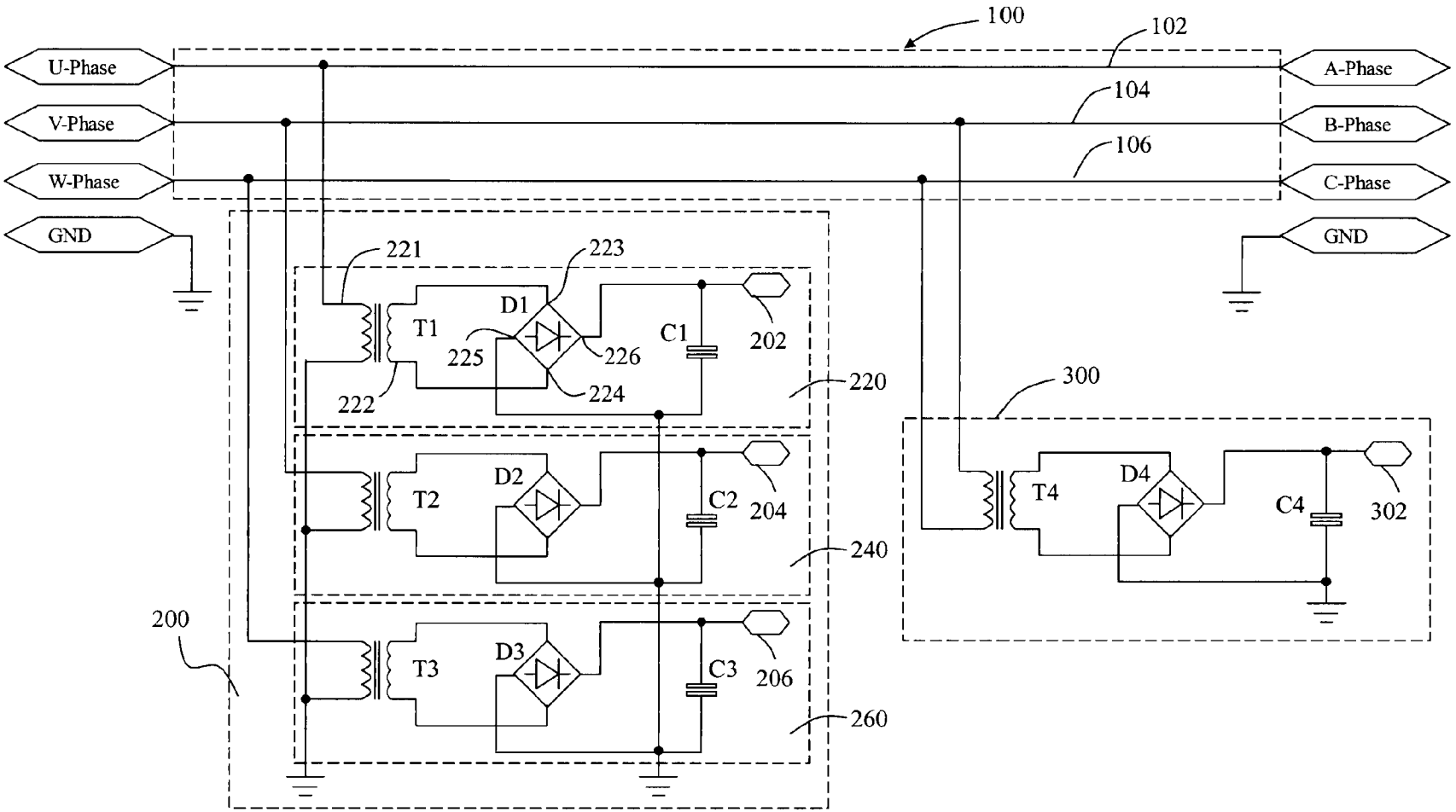
FIG. 2 is a schematic diagram showing a concrete structure of the sampling circuit, and the reference-voltage circuit of FIG. 1.

Referring also to FIG. 2, the transmission lines 100 includes three live wires 102, 104, 106. An end of each of the live wires 102, 104, 106 is connected between a U-phase terminal, a V-Phase terminal, and a W-phase terminal of a three phrase generator respectively. Another end of each of the live wires 102, 104, 106 is connected to a U-phase terminal, a V-Phase terminal, and a W-phase terminal of a three phrase load respectively.

The sampling circuit 200 includes a first sampling module 220, a second sampling module 240, and a third sampling module 260. An end of each of the first sampling module 220, the second sampling module 240, and the third sampling module 260 is connected to the live wires 102, 104, 106 respectively. Another end of each of the first sampling module 220, the second sampling module 240, and the third sampling module 260 is connected to ground. The first sampling module 220 includes a transformer T1, a rectifier D1, and a filter C1. The second sampling module 240 includes a transformer T2, a rectifier D2, and a filter C2. The third sampling module 260 includes a transformer T3, a rectifier D3, and a filter C3. The three sampling modules 220, 240, 260 have similar structures and functions. Hereinafter, the first sampling module 220 is depicted as an example representing the three sampling modules 220, 240, 260.

An end of a primary coil 221 of the transformer T1 is electrically connected to the live wire 102, and another end of the primary coil 221 is connected to ground. The transformer T1 is used to sample the line voltage of the live wire 102. Two ends of the secondary coil 222 are respectively coupled to two input terminals 223, 224 of the rectifier D1. A ground terminal 225 of the rectifier D1 is connected to ground, and an output terminal 226 of the rectifier D1 is electrically connected to a first terminal 202. An end of the filter C1 is connected to ground, and another end of the filter C1 is electrically connected to the first terminal 202. Similarly, the second sampling module 240 includes a second terminal 204 and the third sampling module 260 includes a third terminal 206.

When the first sampling module 220 operates, the primary coil 221 samples the line voltage $U_A$ and the secondary coil 222 generates a first induced voltage $U_1$ according to the line voltage $U_A$. The first induced voltage $U_1$ is then rectified by the rectifier D1 and filtered by the filter C1 before yielding a first sampled voltage. The first sampled voltage is generated from the first terminal 202.

The reference-voltage circuit 300 includes a transformer T4, a rectifier D4, and a filter C4. Two ends of a primary coil of the transformer T4 are correspondingly connected to the live wire 104, 106. Two ends of a secondary coil of the transformer T4 are correspondingly connected to two input terminals of the rectifier D4. A ground terminal of the rectifier D4 is connected to ground, and an output terminal of the rectifier D4 is electrically connected to a fourth terminal 302. An end of the filter C4 is connected to ground, and another end of the filter C4 is also connected to the fourth terminal 302.

When the reference-voltage circuit 300 operates, the transformer T4 receives the line-to-line voltage between the live wire 104 and the live wire 106 and generates a second induced voltage. The second induced voltage is then rectified by the rectifier D4 and filtered by the filter C4 before yielding the standard voltage. The first sampled voltage is generated from the fourth terminal 302.

Figure 3:
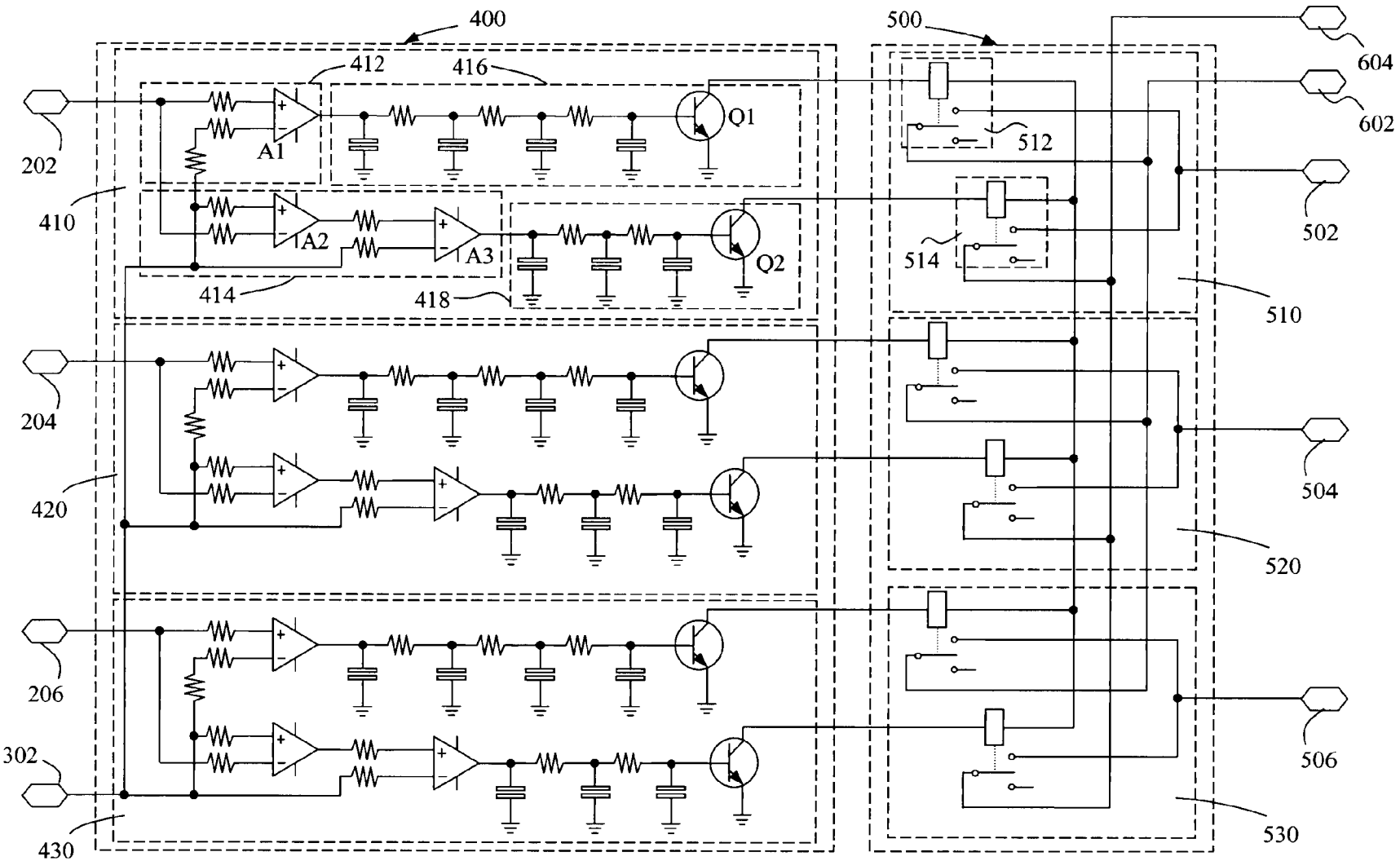
FIG. 3 is a schematic diagram showing a concrete structure of the comparator, and the switch of FIG. 1.

Referring to FIG. 3, the comparator 400 includes a first comparing module 410, a second comparing module 420, and a third comparing module 430. The first comparing module 410 is electrically connected to the first terminal 202, the fourth terminal 302, and the switch 500. The second comparing module 420 is electrically connected to the second terminal 204, the fourth terminal 302, and the switch 500. The second comparing module 430 is electrically connected to the third terminal 206, the fourth terminal 302, and the switch 500. The three comparing modules 410, 420, 430 have similar structures and functions. Hereinafter, the first comparing module 410 is depicted as an example representing the three comparing modules 410, 420, and 430.

The first comparing module 410 includes a first comparing unit 412, a second comparing unit 414, a first time-delay unit 416, and a second time-delay unit 418. The first comparing unit 412 and the second comparing unit 414 are used for comparing the first sampled voltage with the standard voltage. If the first sampled voltage is greater than the standard voltage, the first comparing unit 412 generates a first output voltage, otherwise the second comparing unit 414 generates a second output voltage. The first time-delay unit 416 is for delaying the first output voltage and the second time-delay 418 is for delaying the second output voltage.

The first comparing unit 412 includes an operational amplifier (op-amp) A1. A noninverting input of the op-amp A1 is connected to the first terminal 202 via a resistor, an inverting input is connected to the fourth terminal 302 via two serial resistors, and an output is connected to the first time-delay unit 416.

The first time-delay unit 416 includes a first RC (Resistor and Capacitor) network and a bipolar junction transistor (BJT) Q1. An end of the first RC network is connected to the output of the op-amp A1, and another end of the RC network is connected to a base of the BJT Q1. An emitter of the BJT Q1 is connected to ground, and a collector of the BJT Q1 is connected to the switch 500.

The op-amp A1 is for comparing the first sampled voltage with the standard voltage. The first RC network and the BJT Q1 are used to delay the first output voltage. The first RC network includes four capacitors and three resistors. The three resistors are serially connected between the op-amp A1 and the BJT Q1. There are four interconnections among the op-amp A1, the BJT Q1, and the three resistors. Each interconnection is connected to ground via one of the four capacitors respectively.

When the first RC network receives the first output voltage, four parallel connected capacitors charge in turn to delay the first output voltage. When the base of the BJT Q1 receives the first output voltage, the BJT Q1 turns on and allows the switch 500 operate.

The second comparing unit 414 includes op-amps A2, and A3. A noninverting input of the op-amp A2 is connected to the fourth terminal 302 via a resistor, and an inverting input of the op-amp A2 is connected to the first terminal 202, and an output is connected to a noninverting input of the op-amp A3 via a resistor. An inverting input of the op-amp A3 is connected to the fourth terminal 302. An output of the op-amp A3 is connected to the second time-delay unit 418.

The second time-delay unit 418 includes a second RC network and a BJT Q2. One end of the second RC network is connected to the output of the op-amp A3, and another end of the RC network is connected to a base of the BJT Q2. An emitter of the BJT Q2 is connected to ground, and a collector of the BJT Q2 is connected to the switch 500.

The op-amps A2, and A3 are for comparing the first sampled voltage with the standard voltage. The second RC network and the BJT Q2 are combined to delay the first output voltage. The second RC network includes three capacitors and two resistors. The two resistors are serially connected between the op-amp A1 and the BJT Q1. There are three interconnections among the op-amp A1, the BJT Q1, and the two resistors. Each interconnection is connected to ground via one of the three capacitors respectively.

When the second RC network receives the second output voltage, three parallel connected capacitors charge in turn to delay the second output voltage. When the base of the BJT Q2 receives the second output voltage, the BJT Q2 is enabled and actuates the switch 500.

The switch 500 is connected to a fifth terminal 602 of the power supply 600 to receive a positive voltage, and connected to a sixth terminal 604 of the power supply 600 to receive a negative voltage. The switch 500 includes three switching modules 510, 520, 530. The switching module 510 is connected to the first comparing module 410, the fifth terminal 602, and the sixth terminal 604. The switching module 510 includes a seventh terminal 502. The switching module 520 is connected to the second comparing module 420, the fifth terminal 602, and the sixth terminal 604. The switching module 520 includes an eighth terminal 504. The switching module 530 is connected to the third comparing module 430, the fifth terminal 602, and the sixth terminal 604. The switching module 530 includes a ninth terminal 506. Hereinafter, the switching module 510 is depicted as an example representing three switching modules 510, 520, 530.

The switching module 510 includes a first relay 512 and a second relay 514. The first relay 512 is connected to the collector of the BJT Q1 of the first time-delay unit 416, the fifth terminal 602, and the seventh terminal 502. The second relay 514 is connected to the collector of the BJT Q2 of the second time-delay unit 418, the sixth terminal 604 and the seventh terminal 502.

When the BJT Q1 is enabled, the first relay 512 leads the positive voltage from the fifth terminal 602 to the seventh terminal 502. When the BJT Q2 is enabled, the second relay 514 leads the negative voltage from the sixth terminal 604 to the seventh terminal 502.

Figure 4:
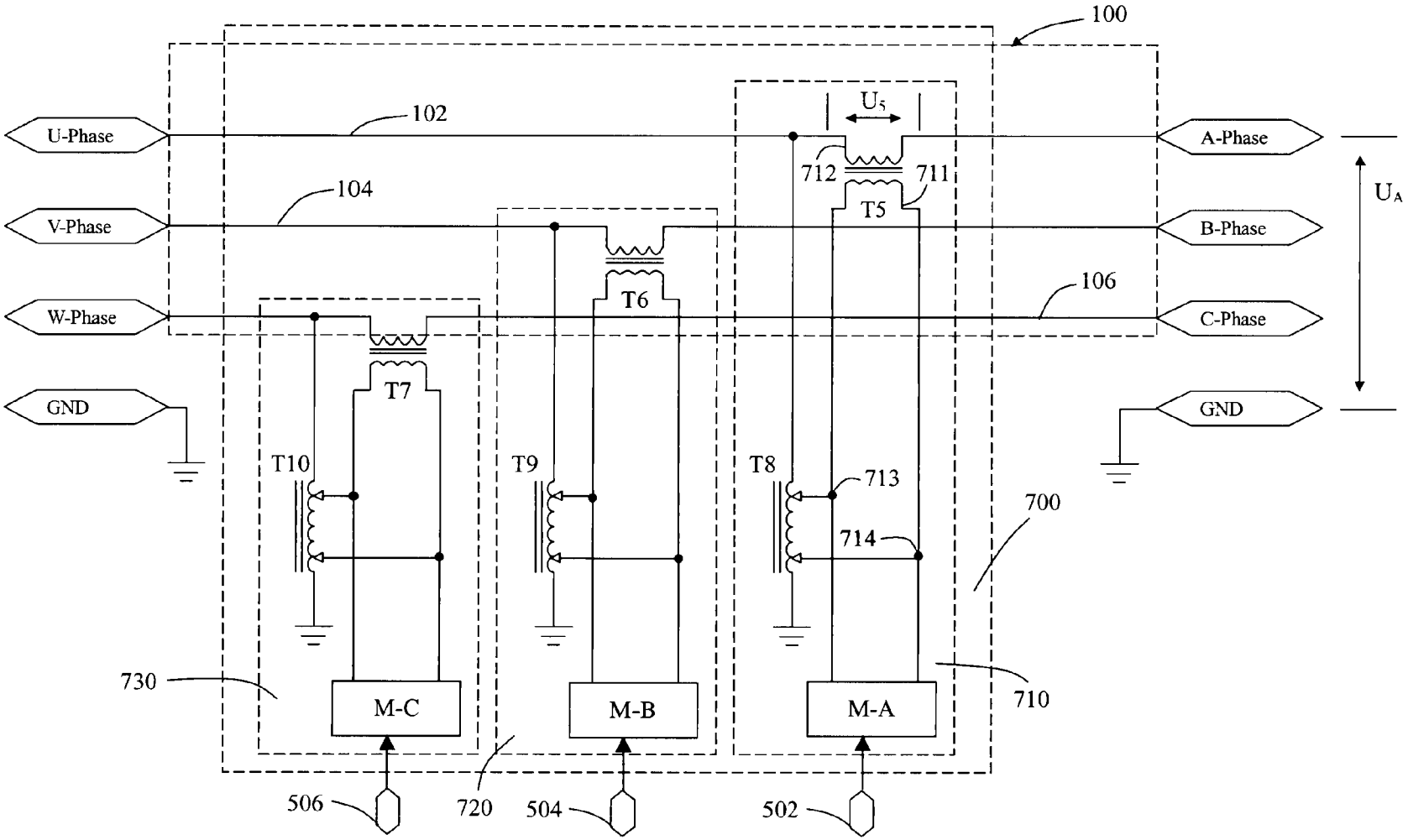
FIG. 4 is a schematic diagram showing a concrete structure of the compensator of FIG. 1.
Figure 5:
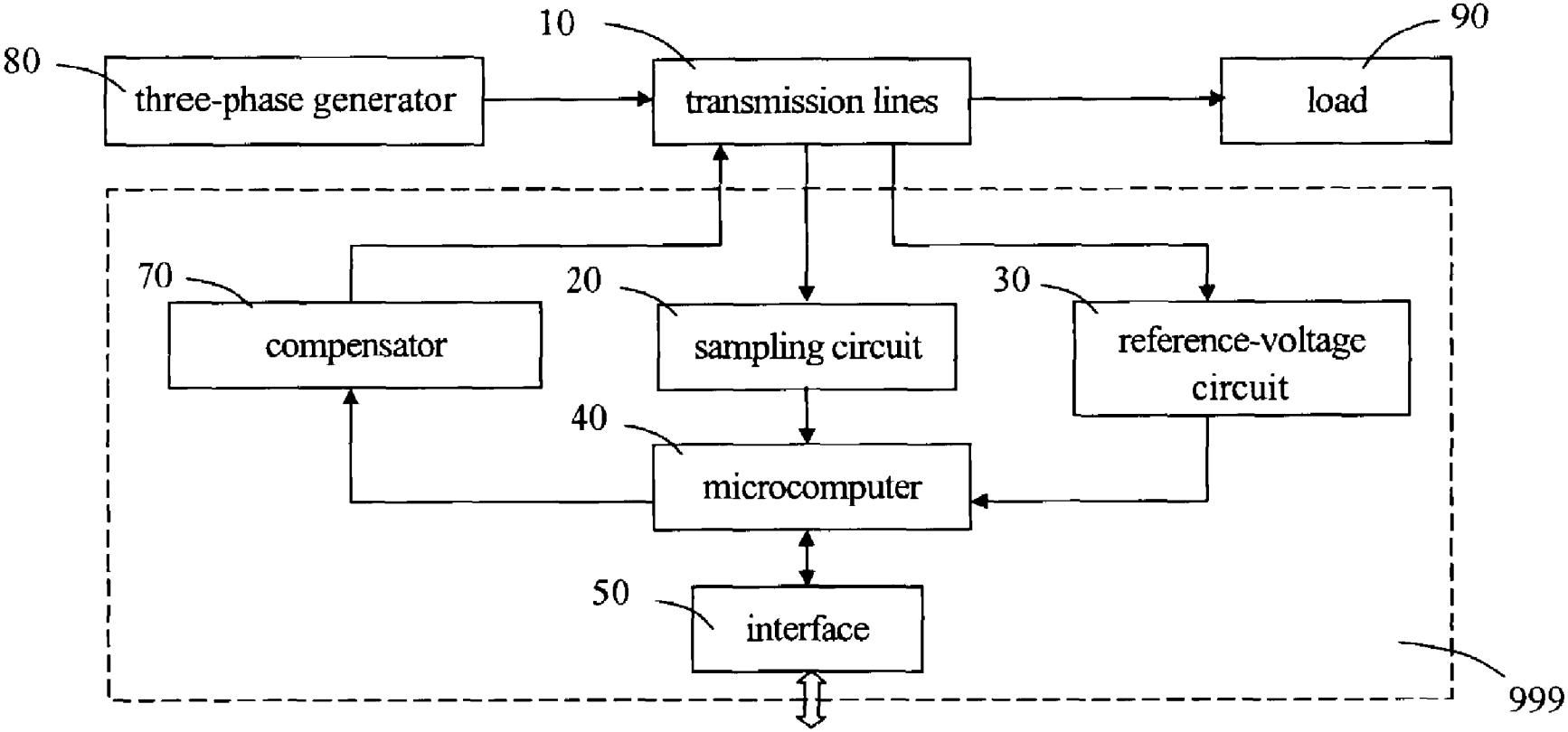
FIG. 5 (RELATED ART)
FIG. 5 is a block diagram showing a conventional three-phase AC voltage regulator.

Referring to FIG. 4, the compensator 700 includes three compensating modules 710, 720, 730. The compensating module 710 is connected to the transmission lines 100 and a seventh terminal 502. The compensating module 710 includes a transformer T5, an adjustable transformer T8, and a motor M-A. The compensating module 720 is connected to the transmission lines 100 and an eighth terminal 504. The compensating module 720 includes a transformer T6, an adjustable transformer T9, and a motor M-B. The compensating module 730 is connected to the transmission lines 100, and an ninth terminal 506. The compensating module 730 includes a transformer T7, an adjustable transformer T10, and a motor M-C. The three compensating modules 710, 720, 730 have similar structures and functions. Hereinafter, the compensating module 710 is depicted as an example representing three compensating modules 710, 720, 730.

Two ends of a primary coil 711 of the transformer T5 are correspondingly connected to two slidable contacts 713, 714 of the adjustable transformer T8. The slidable contacts 713, 714 are also connected to the motor M-A. A secondary coil 712 of the transformer T5 is connected to the live wire 102. The motor M-A is connected to the seventh terminal 502. A end of the adjustable transformer T8 is connected to the live wire 102, and the other end is connected to ground.

When the adjustable transformer T8 and the transformer T5 operate, the secondary coil 712 generates an induced voltage $U_5$. The induced voltage $U_5$ is fed back to the line voltage $U_A$. The motor M-A receives the positive voltage or the negative voltage from the seventh terminal 502, to rotate in a positive direction or a negative direction directly. Therefore, the slidable contacts 713, and 714 are moved by the motor M-A to further adjust the adjustable transformer T8.

The comparator 400 and the switch 500 are used in the three-phase AC voltage regulator 888 to control the compensator 700. Herein, the comparator 400 and the switch 500 are composed of ordinary electronic components, such as op-amp, BJT, resistor, and capacitor. Therefore, the three-phase AC voltage regulator 888 is cheaper.

It should be emphasized that the above-described preferred embodiment, is merely a possible example of implementation of the principles of the invention, and is merely set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and be protected by the following claims.

What is claimed is:

1. A three-phase AC voltage regulator for adjusting a line voltage on transmission lines, the three-phase AC voltage regulator comprising:

a sampling circuit for sampling the line voltage;

a reference-voltage circuit for receiving a line-to-line voltage from the transmission lines and generating a standard voltage;

a comparator for comparing the line voltage and the standard voltage to obtain a signal;

a power supply for supplying an electric power;

a compensator for receiving the electric power and generating compensating voltages to be used to compensate the line voltage; and a switch for switching the electric power to the compensator based on the signal.

2. The three-phase AC voltage regulator according to claim 1, wherein the comparator comprises a first comparing unit for generating a first output voltage when the sampled voltage is greater than the standard voltage, and a second comparing unit for generating a second output voltage when the sampled voltage is smaller than the standard voltage.

3. The three-phase AC voltage regulator according to claim 2, wherein the comparator also comprises a first time-delay unit for delaying the first output voltage, and a second time-delay unit for delaying the second output voltage.

4. The three-phase AC voltage regulator according to claim 3, wherein the power supply comprises a positive voltage terminal for outputting a positive voltage, and a negative voltage terminal for outputting a negative voltage.

5. The three-phase AC voltage regulator according to claim 4, wherein the switch comprises a switching module connected to the comparator, the positive voltage terminal, and the negative voltage terminal.

6. The three-phase AC voltage regulator according to claim 5, wherein the switching module comprises a first relay for switching the positive voltage to the compensator, and a second relay for switching the negative voltage to the compensator.

7. The three-phase AC voltage regulator according to claim 6, wherein the first comparing unit comprises a first operational amplifier, and a noninverting input of the first operational amplifier is for receiving the sampled voltage, and an inverting input of the first operational amplifier is for receiving the standard voltage, and an output of the first operational amplifier is for outputting the first output voltage.

8. The three-phase AC voltage regulator according to claim 7, wherein the first comparing unit comprises a second operational amplifier, and a noninverting input of the second operational amplifier is for receiving the standard voltage, and an inverting input of the second operational amplifier is for receiving the sampled voltage, and an output of the second operational amplifier is for outputting a third output voltage.

9. The three-phase AC voltage regulator according to claim 8, wherein the first comparing unit comprises a third operational amplifier, and a noninverting input of the third operational amplifier is for receiving the third output voltage, and an inverting input of the third operational amplifier is for receiving the standard voltage, and an output is for outputting the second output voltage.

10. The three-phase AC voltage regulator according to claim 9, wherein the first time-delay unit comprises a first RC network and a first bipolar junction transistor, one end of the first RC network is connected to the output of the first operational amplifier, and the other end of the RC network is connected to a base of the first bipolar junction transistor.

11. The three-phase AC voltage regulator according to claim 10, wherein an emitter of the first bipolar junction transistor is connected to ground, and a collector of the first bipolar junction transistor is connected to the first relay.

12. The three-phase AC voltage regulator according to claim 11, wherein the second time-delay unit comprises a second RC network and a second bipolar junction transistor, one end of the second RC network is connected to the output of the third operational amplifier, and the other end of the RC network is connected to a base of the second bipolar junction transistor.

13. The three-phase AC voltage regulator according to claim 12, wherein an emitter of the second bipolar junction transistor is connected to ground, and a collector of the second bipolar junction transistor is connected to the second relay.

14. A three-phase AC voltage regulator for adjusting a line voltage on transmission lines, the three-phase AC voltage regulator comprising:

a sampling circuit electrically connected to the transmission lines;

a comparator electrically connected to the sampling circuit;

a reference-voltage circuit electrically connected to the transmission lines to receive a line-to-line voltage and to generate a standard voltage to the comparator;

a switch electrically connected to the comparator;

a power supply electrically connected to the switch; and a compensator electrically connected between the switch and the transmission lines.

15. The three-phase AC voltage regulator according to claim 14, wherein the comparator comprises an operational amplifier, and a noninverting input of the operational amplifier is electrically connected to the sampling circuit, and an inverting input is electrically connected to the reference-voltage circuit.

16. The three-phase AC voltage regulator according to claim 14, wherein the switch comprises a relay electrically connected to the comparator, the power supply, and the compensator.

17. The three-phase AC voltage regulator according to claim 14, wherein the compensator comprises a transformer, an adjustable transformer, and a motor, and the transformer and the motor are electrically connected to the adjustable transformer and the switch.

18. The three-phase AC voltage regulator according to claim 14, wherein the sampling circuit comprises a transformer, and a primary coil of the transformer is electrically connected to the transmission lines.

19. The three-phase AC voltage regulator according to claim 18, wherein the sampling circuit comprises a rectifier electrically connected to a secondary coil of the transformer, and a filter electrically connected to the rectifier.

20. The three-phase AC voltage regulator according to claim 15, wherein the comparator comprises a RC network and a bipolar junction transistor, and one end of the RC network is electrically connected to an output of the operational amplifier, and the other end of the RC network is electrically connected to a base on the bipolar junction transistor.

* * * * *